US005082278A

United States Patent [19]

Hsien

[11] Patent Number: 5,082,278

[45] Date of Patent: * Jan. 21, 1992

[54] GOLF CLUB HEAD WITH VARIABLE CENTER OF GRAVITY

[76] Inventor: James C. Hsien, 4601 Stillwater Crt., Concord, Calif. 94521

[ * ] Notice: The portion of the term of this patent subsequent to Nov. 28, 2006 has been disclaimed.

[21] Appl. No.: 507,775

[22] Filed: Apr. 12, 1990

[51] Int. Cl.[5] ..... A63B 53/08

[52] U.S. Cl. ..... 273/164; 273/167 J; 273/171; 273/173

[58] Field of Search ..... 273/167-175, 273/77 A, 164, 183 D; D21/219, 220

[56] References Cited

U.S. PATENT DOCUMENTS

| | | | |
|---|---|---|---|
| 1,569,212 | 1/1926 | Aitken | 273/175 X |
| 2,005,401 | 6/1935 | Storz | 273/175 |
| 3,893,672 | 7/1975 | Schoniter | 273/167 A |
| 4,630,827 | 12/1986 | Yoneyama | 273/169 |
| 4,792,140 | 12/1988 | Yamaguchi et al. | 273/173 |
| 4,854,581 | 8/1989 | Long | 273/77 A |
| 4,986,541 | 1/1991 | Teramoto et al. | 273/77 A |

FOREIGN PATENT DOCUMENTS

| | | | |
|---|---|---|---|
| 19988 | of 1903 | United Kingdom | 273/167 J |
| 2194737 | 3/1988 | United Kingdom | 273/77 A |

OTHER PUBLICATIONS

"Golf World", Magazine, Jun. 1977 Issue, pp. 6-7.

*Primary Examiner*—Benjamin Layno
*Assistant Examiner*—Sebastiano Passaniti
*Attorney, Agent, or Firm*—Richard C. Litman

[57] ABSTRACT

A solid club head with a substantial vertical hosel with a horizontal portion extending between a toe portion to a heel portion with an inclined front face and a curved back face. The back face has a contour of variable radii of curvature from a very large radius at the upper reaches of the horizontal portion of the head to a very small radius of curvature at the lower reaches of the horizontal head portion. The back face has several recesses disposed along the expanse of the back face. There are one long upper recess and two lower recesses just below the upper recess coextensive with the long upper recess. Additive masses are insertable into said two lower recesses. The inclined front face has horizontal lines with triangular lands or unmachined lines amid the horizontal lines for proper orientation of the club in the hands of the player.

6 Claims, 1 Drawing Sheet

GOLF CLUB HEAD WITH VARIABLE CENTER OF GRAVITY

CROSS-REFERENCE TO RELATED APPLICATIONS

Application Ser. No. 07/244,480, filed Sept. 15, 1988 and now U.S. Pat. No. 4,883,274, contained subject matter similar to that disclosed in the present application.

BACKGROUND OF THE INVENTION

1. Field of the Invention

The purpose of the present invention is to present a golf club head that will add weight to two positions in the head to affect the location of the "sweet" spot in the head. When a ball is hit at this spot, it will only rise and fall in the distance it travels and will tend to have little slice or hook. The ball when hit at the "sweet" spot will tend to have much less sidespin making the ball aerodynamically neutral thus reducing hooking and slicing. An individual golfer would like to adjust his club to give it a tendency to slice or hook to counteract his own swing tendencies.

By making the weighting of the club adjustable, the center of gravity of the head may be shifted and the total mass of the head made greater. The total mass is adjusted to the build of the individual golfer. This shifts the center of gyration of the club as a whole and thus controls the location of the "sweet" spot; higher, lower, toward the toe, or toward the heel. If a golfer has a need for hooking the ball in his shot to meet the topography of the fairway, he can select a club with a tendency to hook because of its weight distribution throughout the head. A slicing club will serve some purposes, too. By the weight adjustment of the club of this invention a golfer can select a club modified according to this invention that meets his immediate needs on the golf links. It is to be emphasized that the club is for counteracting the player's natural tendencies for the player's need rather than being for any particular shot.

By utilizing a triple-cavity back, swingweight material is added into the heel and toe cavities for final swingweighting adjustments. The additive materials are dense and comprised of two different sets. The weights that are fitted into the heel area of the club head are overall smaller and thinner than other weights fitted into the toe pocket. The placement of the center of gravity is adjusted for the demands of an individual golfer by selecting one or more weights from a group of weights. This will move the sweet spot inside, outside, or on the linear center of the club face. This method has proven far more effective in maintaining the heel-to-toe end-weighting design of the club. Face-centered sweet spots give a wider sweet spot impact area, and with heavy heel-and-toe weight emphasis, greater face deflection control of the ball is built into the design.

By swingweighting directly into the head, rather than the usual practice of pouring lead down the shaft, toe weight is increased instead of being reduced. (Toe weight emphasis relates directly to slice control for the average golfer.) The two cavities used for adjusting swingweight are permanently sealed with a metal plate integral to the cavity design. The present invention utilizes a horizontal rib that not only places weight (mass) directly behind the ball but, even more importantly, reinforces the face wall to eliminate face flex and vibration at impact. (Basic cavity back irons without this rib are subject to loss of ball compression energy through face-flexing at impact.)

Low center of gravity is one of the basic design objectives of the present golf club to promote ball loft, and its short hosel and thin top edge, and expanding toe design fully achieve that objective. The weight and balance dynamics of the iron give maximum potential of high trajectory shots for the average player, yet does not overpower the efforts of a better player in working the ball under all playing conditions.

The pronounced radius of the sole enables the player to get the club head down to the ball from divot or ragged lies. The irons are compact, and versatile clubs. Their blunted and upturned leading edges glide the club head through heavy turf without biting and digging in which will diminish head speed. A distinctive scoreline design focuses the golfer's eye on the center of the impact area for consistent shot-making. This scoreline design helps to aim the club as it addresses the ball in order to prevent unwanted amounts of hook or slice.

Most of all club makers have sought to perfect the weight distribution in the golf iron head from heel to toe for the purpose of relocating the neutral axis, more commonly called the sweet spot in golf, to the center of the club face. This would give the average golfer more room for error in making contact with the ball, since added clubhead weight in the toe would resist face deflection for impacts made outside the sweet spot towards the toe. Though the single cavity low in the sole creates some endweighting and all the added weight is very low in the sole, insufficient weight is maintained directly behind the ball. It has been proven that if weight is too concentrated in the sole, the club creates lofted leverage with a corresponding amount of ball backspin—the most important club-to-ball characteristic in shot-making. Since all manufacturers attempt to produce sets of clubs for ladies, juniors, seniors, and above-average adult men from the same set of investment casting molds, the basic head design must be practical from the standpoint that if special construction design elements are used—as a vent in the sole, a tungsten pellet at the extreme section of the toe and the use of three tubes into the head by other designers—clubs made for the extreme in the lightweight, swingweight and gross-weight categories would require that only lightweight filler be used to fill these referred-to cavities. A design that creates basic and desirable weight in the toe and is subordinated to the heel yet possesses rigidity behind the impact area with the intersecting "I-beam" type design of the present invention leaves the door open for swingweight enhancement. Powdered lead and other similar metals do not provide the solid feel nor the actual weight per cubic centimeter to allow adjustments to balance of heel and toe weight. In all but the traditional professional tour play does the mere equalization of weight from heel to toe suffice. In tests and in use it has been proven that greater weight is required in the toe for the average player while the opposite is true for expert players that learned to make impact near the heel/hosel area of the club face. Thus the present invention allows even for that extreme by unweighting the toe pocket and increasing the heel weight pocket to move the center of gravity inside the linear center of the club face. To the other extreme, clubs specified for the average lady golfer require only the lightest weight, usually in the toe pocket. The overall weight of the clubs of the present invention are 20–30 grams lighter than the typical set of irons. This allows making all swingweight and gross-weight allocations directly into the back of the club head and thereby eliminate the practice of adding such weight down the shaft which unweights the toe. Use of resilient materials in the club head to lessen shock and vibration lack weight and force, while solid lead is known to absorb shock and is used in many industrial applications to do just that. Other adjustable weighting ideas were dismissed in view of the U.S. Golf Association's rules on golf club adjustability by simple means. Screws, bolts and other easily manipulative mechanical devices meet with resistance and generally are rejected by the U.S. Golf Association.

2. Description of the Prior Art

U.S. Pat. No. 3,419,275 to A. R. Winkleman is drawn to a golf putter with a strongly magnetized weight-adjusting means placed on the back of the putter and formed as a new back face to the putter.

U.S. Pat. No. 2,155,830 to J. J. Howard discloses a putter with an adjustable head. There is provided an adjustably fixable articulated joint directly connecting the head to the stem and adjustably fixable in a predetermined plane. Weights are also disclosed which are adjustably located along the back of the head and the weights are held in place in a dovetail groove by a special nut fixed wedgedly in the dovetail groove and fastened by a screw thread.

U.S. Pat. No. 4,607,846 to S. J. Perkins discloses a golf club head with two bores extending obliquely to each other from the toe toward the heel meeting in a partially cylindrical cavity. The bores and cavity contain weights which are adjustably situated to change the center of gravity position in the head.

U.S. Pat. Nos. 3,995,864 and 3,995,865 to A. J. Cochran et al. are drawn to a club "iron" that has concentrated weights embedded in the back face to affect the center of gravity and the radius of gyration of the whole club.

U.S. Pat. No. 3,845,960 to A. C. Thompson is drawn to a golf club head with a single bore extending from toe to heel of the head using aluminum and tungsten powder. The aluminum rod is centrally disposed and extended in the head and tungsten powder is confined in the heel between the aluminum, rod and another plug in an aperture in the heel.

U.S. Pat. No. 3,966,210 to J. J. Rozmus discloses various types of clubs with different forms of weights which are inserted into the club heads: wood, iron and putter.

U.S. Pat. No. 2,846,228 to M. B. Reach is drawn to a golf club of the iron type with a recess in the back face and filled with rubber weighting material.

SUMMARY OF INVENTION

It is an object of the invention to make the weight distribution on a club adjustable by having movable weights spaced appreciably from the hosel of the club head.

It is a further object of the invention to make a club that in the hands of a particular golfer tends to impart hook or slice to a golf ball.

It is a further object of this invention to keep the center of gravity of the head horizontally adjustable and low in the head.

It is a further object of this invention to give indication of the correct orientation of the club in the hands of a golfer by means of triangular lands or unmachined lines on the front face of the head.

It is another object of this invention to provide a golf club head having a lower leading edge which is offset from the lowest portion of the shank or hosel.

These and other objects of the present invention will become readily apparent upon review of the following specification and the attached drawings.

DETAILED DESCRIPTION

Figure 1:
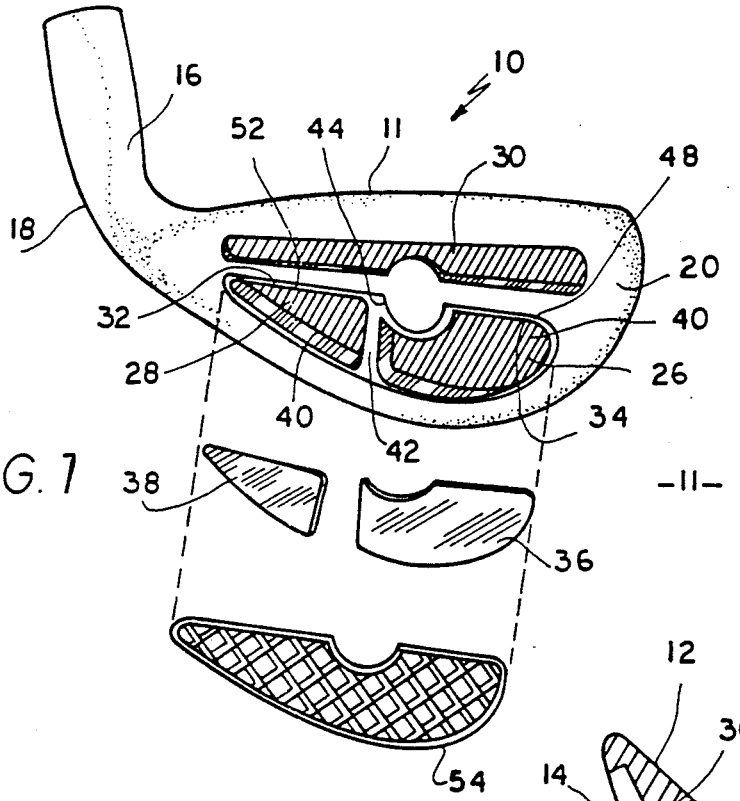
FIG. 1 is a view of the back face of the club of the present invention.
Figure 2:
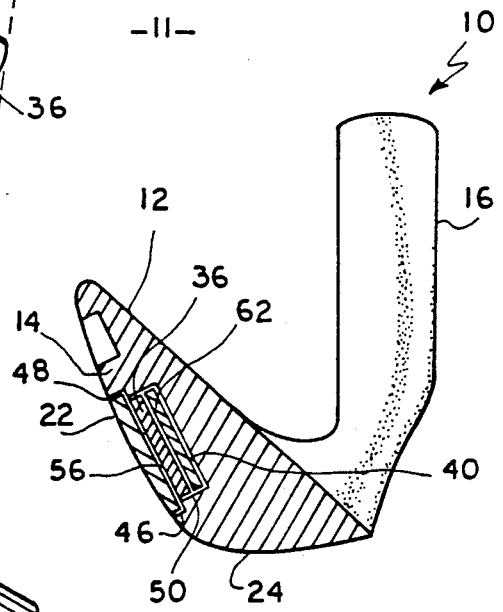
FIG. 2 is a section view of the club head section taken midway between the toe and heel of the club head and parallel to the hosel to show the recesses for the weights in profile, along the plane 2—2 in FIG. 3.
Figure 3:
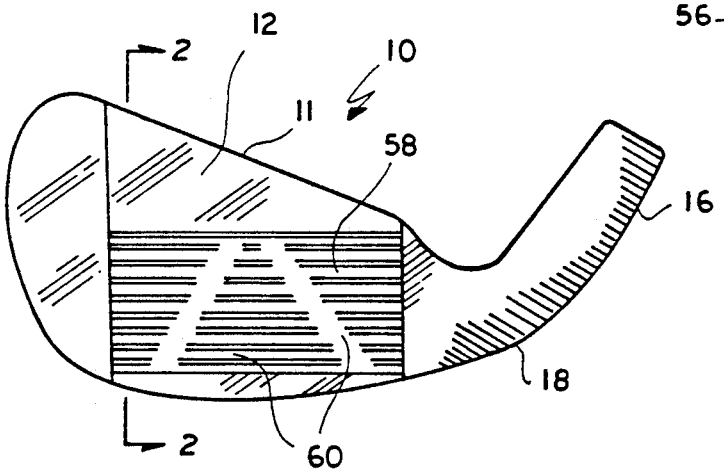
FIG. 3 is a view of the front face of the club showing the triangular shaped lands amid the horizontal lines on the front face of the club head.

This invention is drawn to golf clubs with a head 10 having an inclined flat front face 12 and a curved back face 14. The head 10 is designed to be mounted on the shaft by means of hosel 16. The remainder of the head is formed as a generally horizontal top portion 11 having the front face 12 and back face 14 extended from the heel 18 where the hosel 16 is situated out to the toe 20, the end of the head remote from the hosel 16. The back face 14 meets the inclined front face 12 at the horizontal sole portion 24 in a curve on the edge of the plane of the front face with a forwardmost limit to the curve. The hosel 16 has a forwardmost limit, the limit of the curve being offset from the forwardmost limit of the hosel by an amount ranging from 1/32 inch to ⅜ inch. This particular feature is best illustrated in FIG. 2.

The back face 14 has a contour of variable radius of curvature from a very large radius at the upper reaches 22 of the horizontal top portion 11 of the head to a very small radius of curvature at the lower reaches or horizontal sole 24 of the horizontal top portion 11. There are three recesses 26, 28 and 30 inset in said contour of very large radius of curvature including one upper long recess 30 and two lower shorter recesses 26 and 28 with two rims 32 and 34 coextensive with and just below the upper recess 30. One of the two lower recesses 26 is closer to the toe than the other of said recesses 26 and 28 which is closer to the heel 18 of the horizontal portion 11 of the club head 10. The two lower recesses 26 and 28 may receive weight 36 and 38 of complementary shape for fitting in the recesses 26 and 28. The bottoms 40 of the two lower recesses are flat. The contour of the back face 14 has such a large radius of curvature where the recesses are located that the contour appears also almost flat too. The flat bottoms 40 of the recesses are substantially parallel to the flat contour of the back face 14 of the head 10 of the club.

A vertical partition 42 completely separates the two lower recesses 26 and 28 from each other and the rims 32 and 34 of these two lower recesses 26 and 28 are in the same plane 44.

The lower recesses 26 and 28 go to make the bottom portion of a larger fourth recess 46. The rim of the fourth recess 52 is along the contour of the back face 14 and is outside the rims 32 and 34 of the two lower recesses 26 and 28 countersunk fashion. The two lower recesses make up the bottom portion 50 of the fourth recess 52.

There is a cover element 54 for covering the additive masses 36 and 38 which is flush with the almost flat contour portion 22 of the back face of the head of the club. The bottom 56 of the cover element is flat and in the plane 44 of the rims of the two lower recesses 26 and 28 already described.

For proper orientation of the club when in the hands of a golfer, there are horizontal lines 58 inscribed on the inclined front face 12 of the club and disposed amid the lines are lands or unmachined lines 60 in triangular form. This design form serves as means of aiming the ball when it takes flight by contacting the club and ball at the proper position along the club front face 12. While properly hitting the ball, the non-machined lines 60 contact the dimples on a conventional golf ball to form a vacuum condition, which forces the ball to fly in a straight ahead trajectory.

By placing one additive mass 38 of selected density, e.g. lead or tungsten, in the lower recess 28 near the heel 18, the center of gravity of the head of the club is shifted toward the heel to shift the "sweet" spot for affecting the spin of the ball hit by the club. The additive mass means increases the angular momentum when the shaft is swung by 4 to 7.5 percent with an increase in the radius of gyration and the mass of the club head. By placing one additive mass 36 in the lower recess 26 near the toe 20 the center of gravity of the head 10 of the club is shifted more in the direction of the toe 20, again affecting the location of the sweet spot. The advantage served by having the weights 36 and 38 outside the portion of the head of the club near the usual location of the hosel 16 is to limit the shifting of the sweet spot. Also having the lower recesses 26 and 28 filled with additive mass 36 and 38 makes the center of gravity lower in the head, affecting the height of the trajectory of a ball hit by a golfer using this club.

The shape of the two lower recesses 26 and 28 being different and incongruous gives the advantage of not being able to misplace the wrong weight in either of the recesses. The additive mass can be a plurality of flat weights 36 and 62 that serve to take up the volume of one of the recesses. To make a fraction of the weight, a compressible lightweight filler material 62 in the shape of the recess may go to take all the remaining volume of the recess 26 or 28 when only one of these weights is present. A fraction of the weight will have a different effect on the "sweet" spot of the head of the club.

I claim:

1. A golf club head comprising:

a substantially vertical hosel adapted for attachment to a shaft;

said head having horizontal top and sole portions extending between a toe portion and heel portion with an inclined front face in a single plane and curved back face;

said back face having a contour of variable radii of curvature from a larger radius at the top horizontal portion of the head to a smaller radius of curvature at the horizontal sole portion of the head;

said back face comprising recesses inset in said back face of larger radius of curvature including one upper long recess and two lower separate shorter recesses with two rims in the same plane and coextensive with and just below the upper recess;

said lower recesses being capable of retaining a plurality of additive mass means and being completely separated by a vertical partition, the bottom thereof being flat and substantially parallel to the contour of the back face;

additive mass means for insertion in said two lower recesses;

a fourth recess comprising said lower recesses and having in the contour of very large radius of curvature a further rim separated from the plane of the rims of said two lower recesses, said rim of said fourth recess being outside the rims of the two lower recesses in countersuck fashion; and a cover element for insertion in said fourth recess to cover said additive mass while being flush with said contour of said back face with said radius of curvature.

2. The golf club head of claim 1 wherein:

the bottom of the two lower recesses are flat and substantially parallel to the contour of the back face where it has a very large radius of curvature.

3. The golf club head of claim 2 further including:

a cover element for covering said additive mass means while being flush with said contour of said back face with said very large radius of curvature.

4. The golf club head of claim 1 wherein:

said back face meets said inclined front face at the said horizontal sole portion in a curve on the edge of the plane of said front face with a forwardmost limit to the curve;

said hosel having a forwardmost limit; and said forwardmost limit of the curve being offset from the forwardmost limit of the hosel by an amount ranging from 1/32 inch to ⅜ inch.

5. The golf club head of claim 1 wherein:

said hosel is fastened to a shaft; and whereby the additive mass means increases the angular momentum when the shaft is swung by 4 to 7.5 percent with an increase in the radius of gyration and the mass of the club head.

6. A golf club head comprising:

a substantially vertical hosel adapted for attachment to a shaft;

said head having horizontal top and sole portions extending between a toe portion and heel portion with an inclined front face in a single plane and curved back face;

said back face having a contour of variable radii of curvature from a larger radius at said top horizontal portion of said head to a smaller radius of curvature at said horizontal sole portion of said head;

said inclined face having horizontal lines inscribed thereon and unmachined lines defining a triangle disposed amid said inscribed horizontal lines, said triangle having opposite sides having unmachined lines both converging near said top portion, and extending in an uninterrupted fashion to adjacent said sole portion to form a triangular pattern, said triangle forming sighting means enabling a player to accurately address a golf ball with said head, whereby;

a horizontally arcuate flight path is achieved by said golf ball when struck by said head, said flight path dependent upon the region of contact of said unmachined lines and said inscribed horizontal lines with said golf ball.

* * * * *